US009752094B2

(12) United States Patent
Takagi et al.

(10) Patent No.: US 9,752,094 B2
(45) Date of Patent: Sep. 5, 2017

(54) WATER-SOLUBLE METALWORKING FLUID, METALWORKING LIQUID, AND METALWORKING METHOD

(71) Applicant: IDEMITSU KOSAN CO., LTD., Chiyoda-ku (JP)

(72) Inventors: Fumiaki Takagi, Kisarazu (JP); Tomohiko Kitamura, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/646,110

(22) PCT Filed: Nov. 19, 2013

(86) PCT No.: PCT/JP2013/081113

§ 371 (c)(1),
(2) Date: May 20, 2015

(87) PCT Pub. No.: WO2014/080884

PCT Pub. Date: May 30, 2014

(65) Prior Publication Data

US 2015/0299599 A1 Oct. 22, 2015

(30) Foreign Application Priority Data

Nov. 20, 2012 (JP) ..... 2012-254692

(51) Int. Cl.

| | |
|---|---|
| ***C10M 173/02*** | (2006.01) |
| ***C10M 173/00*** | (2006.01) |
| ***C10M 141/06*** | (2006.01) |
| ***C10M 129/40*** | (2006.01) |
| ***C10M 129/42*** | (2006.01) |

(52) U.S. Cl.

CPC ..... *C10M 141/06* (2013.01); *C10M 173/00* (2013.01); *C10M 173/02* (2013.01); *C10M 2203/024* (2013.01); *C10M 2207/021* (2013.01); *C10M 2207/022* (2013.01); *C10M 2207/123* (2013.01); *C10M 2207/126* (2013.01); *C10M 2207/127* (2013.01); *C10M 2207/18* (2013.01); *C10M 2207/22* (2013.01); *C10M 2215/04* (2013.01); *C10M 2215/042* (2013.01); *C10M 2215/223* (2013.01); *C10N 2230/16* (2013.01); *C10N 2230/24* (2013.01); *C10N 2230/41* (2013.01); *C10N 2230/42* (2013.01); *C10N 2230/43* (2013.01); *C10N 2230/70* (2013.01); *C10N 2240/401* (2013.01); *C10N 2240/407* (2013.01)

(58) Field of Classification Search

CPC C10M 141/06; C10M 173/00; C10M 173/02; C10M 2203/024; C10M 2207/021; C10M 2207/022; C10M 2207/123; C10M 2207/126; C10M 2207/127; C10M 2207/18; C10M 2207/22; C10M 2215/04; C10M 2215/042; C10M 2215/223; C10N 2230/16; C10N 2230/24; C10N 2230/41; C10N 2230/42; C10N 2230/43; C10N 2230/70; C10N 2240/401; C10N 2240/407

USPC ..... 508/503, 545, 583

See application file for complete search history.

(56) References Cited

U.S. PATENT DOCUMENTS

| | | | |
|---|---|---|---|
| 5,171,903 | A | 12/1992 | Koyama et al. |
| 2012/0058925 | A1 | 3/2012 | Takagi et al. |
| 2012/0184475 | A1 | 7/2012 | Takagi et al. |

FOREIGN PATENT DOCUMENTS

| | | | |
|---|---|---|---|
| JP | 57-159891 | A | 10/1982 |
| JP | 2-242891 | A | 9/1990 |
| JP | 2-269798 | A | 11/1990 |
| JP | 2-281097 | A | 11/1990 |
| JP | 2004-256771 | A | 9/2004 |
| JP | 2009-242743 | A | 10/2009 |
| JP | 2011-111593 | A | 6/2011 |
| WO | 2009/122875 | | 10/2009 |
| WO | WO 2010/113594 | A1 | 10/2010 |

OTHER PUBLICATIONS

Chinese Office Action issued Aug. 17, 2016 in connection with Chinese Patent Application No. 201380060985, filed Nov. 19, 2013.

*Primary Examiner* — James Goloboy
(74) *Attorney, Agent, or Firm* — Oblon, McClelland, Maier & Neustadt, L.L.P.

(57) ABSTRACT

Provided are a water-soluble metalworking oil agent (cutting oil agent or grinding oil agent) and a metalworking liquid, each of which has excellent cutting machining performance or grinding machining performance of aluminum or aluminum alloys, hardly causes rotting deterioration, and has excellent emulsion dispersion stability and stability of undiluted liquid, by containing specified components (A) to (E) as essential components without containing a machinability-improving agent with a high environmental load, such as chlorine, sulfur, and phosphorus. Provided is also a metalworking method using the same.

19 Claims, No Drawings

WATER-SOLUBLE METALWORKING FLUID, METALWORKING LIQUID, AND METALWORKING METHOD

TECHNICAL FIELD

The present invention relates to a water-soluble metalworking oil agent which is used for metalworking including cutting or grinding of metal pieces, to a metalworking liquid, and to a metalworking method using the same.

BACKGROUND ART

In metal machining processes such as cutting and grinding, a metalworking oil agent is used for improving machining efficiency, for preventing abrasion between a workpiece and a tool for machining the workpiece, for prolonging tool life, for removing metal chips, and for other purposes. Such metalworking oil agents include an oil-base agent predominantly containing an oil component such as mineral oil, animal and vegetable oil, or synthetic oil, and a water solubility-imparted agent prepared by incorporating a compound having surface activity into an oil component. From the viewpoints of effective utilization of resources and fire prevention, a water-solubility-imparted agent (referred to as "water-soluble metalworking oil agent") has come to be used more and more in recent years.

For the water-soluble metalworking oil agent (cutting or grinding oil agent), the following performances are demanded.

(a) Machining performance: Under circumstance where an improvement of productivity is demanded, it is considered to be needed to realize more efficient machining. In addition, an oil agent suited for every metal material species is needed.

(b) Rotting resistance: When water and an organic material coexist, rotting deterioration advances, whereby an oil agent performance is lowered.

(c) Emulsion dispersion stability: For the purpose of imparting lubricity, it is need to stably emulsify and disperse a water-insoluble lubrication component in water; however, since water and oil coexist, the metalworking oil agent is in an unstable state. In addition, metals which are eluted from a material to be worked, or the like further make the emulsified and dispersed state unstable.

(d) Stability of undiluted liquid: The form in which the metalworking agent is kept in the production site is an undiluted liquid; however, in many cases, in order to decrease a risk of fire during the storage, water is incorporated. Since water and oil coexist, the metalworking oil agent is in an unstable state. In addition, an undiluted liquid of metalworking oil agent (cutting or grinding oil agent) is often stored outdoors in a state where it is put in a container or the like, and it is exposed to high temperatures in summer and to low temperatures in winter, respectively. Even under such circumstances, it must be stable.

Accordingly, for the purpose of improving machining performance of cutting or grinding or plastic machining, it is proposed to incorporate a linear olefin (α-olefin) having 6 to 40 carbon atoms (see Patent Documents 1 and 2). In addition, for the purpose of providing water-soluble cutting oil which is improved in cutting properties or grinding properties, is low in an offensive smell, is hardly rotted, and is good in defoaming properties, it is proposed to incorporate a salt of ricinoleic acid polycondensate (see Patent Document 3). Furthermore, for the purpose of improving antibacterial properties of a water-soluble cutting oil agent, it is proposed to incorporate an amine having a cyclohexyl group (see Patent Document 4).

PRIOR ART DOCUMENTS

Patent Documents

Patent Document 1: JP-A 2-269798
Patent Document 2: JP-A 2-281097
Patent Document 3: JP-A 57-159891
Patent Document 4: JP-A 2-242891

SUMMARY OF THE INVENTION

Problems to be Solved by the Invention

However, in Patent Documents 1 and 2, solutions to the above-described problems (b) to (d) on the water-soluble metalworking oil agent are not presented, and there was involved such a problem that in the linear olefin (α-olefin), if its carbon number is long, it is solidified at low temperatures. In addition, in the case where the carbon number is short, there was a concern about an offensive smell or stimulation to the skin.

In addition, in Patent Document 3, though solutions to the problems (a) and (b) are presented, it may not be said that such solutions are sufficient. In this case, there was involved such a problem that solutions to the problems (c) and (d) are not presented. Furthermore, in Patent Document 4, though a solution to the above-described problem (b) is presented, sufficient solutions of other problems were not presented.

Under such circumstances, the present invention has been made, and an object thereof is to provide a water-soluble metalworking oil agent (cutting oil agent or grinding oil agent) which has excellent cutting machining performance or grinding machining performance of aluminum or aluminum alloys, hardly causes rotting deterioration, and has excellent emulsion dispersion stability and stability of undiluted liquid, without containing a machinability-improving agent with a high environmental load, such as chlorine, sulfur, and phosphorus, and a metalworking liquid obtained by diluting the water-soluble metalworking oil agent with water, and also a metalworking method using the same.

Means for Solving the Problems

In order to attain the above-described object, the present inventors made extensive and intensive investigations. As a result, it has been found that the object can be attained by incorporating, as essential components, specified components (A) to (E) into a water-soluble metalworking oil agent.

The present invention has been accomplished on the basis of such finding.

Specifically, the present invention provides the following.

[1] A water-soluble metalworking oil agent comprising, as essential components, the following (A) to (E):

(A) an α-olefin containing at least an α-olefin having 14 to 16 carbon atoms, in a content of 15 mass or more and 65 mass % or less in an undiluted liquid composition before being diluted with water;

(B) at least one selected from a dehydration-condensed fatty acid of ricinoleic acid and a dehydration-condensed fatty acid between a ricinoleic acid dehydration-condensed fatty acid and a carboxylic acid, in a content of 5 mass % or more and 30 mass % or less in an undiluted liquid composition before being diluted with water;

(C) at least one selected from a monocarboxylic acid and a dicarboxylic acid, each not containing the component (B);

(D) an alkylamine (D1) and an alkanolamine (D2), each meeting the following (1) to (3) and not containing a hydroxyl group, (1) a content of the component (D1) is 2 mass % or more and 30 mass or less in an undiluted liquid composition before being diluted with water, (2) a total amount of the component (D) is a neutralization equivalent or more of the components (B) and (C), and (3) a ratio of the component (D1) in the component (D) [(D1)/(D1+D2)] is 15 mol % or more and 60 mol % or less; and (E) at least one nonionic surfactant selected from a monohydric alcohol, a polyhydric alcohol, and derivatives thereof;

[2] The water-soluble metalworking oil agent as set forth above in [1], wherein the component (D1) contains at least either dicyclohexylamine or N-methyldicyclohexylamine;

[3] The water-soluble metalworking oil agent as set forth above in [1] or [2], further comprising (F) water;

[4] A metalworking liquid comprising the water-soluble metalworking oil agent as set forth above in any one of [1] to [3], which is diluted with water;

[5] A metalworking method comprising machining a workpiece made of aluminum or an aluminum alloy, with the water-soluble metalworking oil agent as set forth above in any one of [1] to [3];

[6] A metalworking method comprising machining a workpiece made of aluminum or an aluminum alloy, with the metalworking liquid as set forth above in [4]; and

[7] The metalworking method as set for the above in [5] or [6], wherein the metalworking method is cutting or grinding.

Advantageous Effects of the Invention

According to the present invention, it is possible to provide a water-soluble metalworking oil agent (cutting oil agent or grinding oil agent) which has excellent cutting machining performance or grinding machining performance of aluminum or aluminum alloys, hardly causes rotting deterioration, and has excellent emulsion dispersion stability and stability of undiluted liquid, without containing a machinability-improving agent with a high environmental load, such as chlorine, sulfur, and phosphorus, and a metalworking liquid obtained by diluting the water-soluble metalworking oil agent with water, and also a metalworking method using the same.

EMBODIMENTS FOR CARRYING OUT THE INVENTION

First of all, the water-soluble metalworking oil agent of the present invention is described. [Water-soluble metalworking oil agent]

The water-soluble metalworking oil agent of the present invention comprises, as essential components, the following components (A) to (E). Incidentally, the water-soluble metalworking oil agent is an undiluted liquid composition before being diluted with water.

<(A) α-Olefin (Base Oil or Agent to be Emulsified (Insoluble in Water)>

As for the α-olefin that is the component (A) in the present invention, its content in the undiluted liquid composition before being diluted with water is 15 mass % or more and 65 mass % or less, preferably 20 mass or more and 60 mass % or less, and more preferably 25 mass % or more and 60 mass % or less. When this content is less than 15 mass %, sufficient machining performance may not be exhibited, whereas when it is more than 65 mass %, a compounding amount of other components is decreased, whereby performances other than the machining performance may be lowered, or emulsion dispersion stability may be impaired.

In addition, the α-olefin in the present invention contains at least an α-olefin having 14 to 16 carbon atoms. When the carbon number of the α-olefin is less than 14, an offensive smell or stimulation to the skin may possibly become strong, whereas when the carbon number is more than 16, emulsion dispersion stability may be lowered, or the undiluted liquid may be solidified at low temperatures.

<(B) Dehydration-Condensed Fatty Acid of Ricinoleic Acid and Dehydration-Condensed Fatty Acid Between Ricinoleic Acid Dehydration-Condensed Fatty Acid and Carboxylic Acid>

As for the component (B) in the present invention, its content in the undiluted liquid composition before being diluted with water is 5 mass % or more and 30 mass % or less, preferably 5 mass % or more and 25 mass % or less, and more preferably 5 mass % or more and 20 mass % or less. When this content is less than 5 mass %, sufficient machining performance may not be exhibited, whereas when it is more than 30 mass %, effects that correspond to the compounding amount may not be obtained, and a compounding amount of other components is decreased, whereby machining performance or rotting resistance may be impaired.

Examples of the dehydration-condensed fatty acid of ricinoleic acid include polycondensed fatty acids of a fatty acid predominantly containing ricinoleic acid (12-hydroxyoctadec-9-enoic acid) which is obtained from castor oil or the like. When the fatty acid predominantly containing ricinoleic acid is, for example, heated at about 200° C. in an inert atmosphere, dehydration polycondensation commences, and the target dehydration-condensed fatty acid is obtained. The fatty acid predominantly containing ricinoleic acid may contain a fatty acid having a different carbon number from ricinoleic acid, as an impurity derived from castor oil that is a raw material, so long as the original target effects are not hindered.

A polycondensation degree of ricinoleic acid is controlled by a reaction time. When the reaction time is long, an acid value and a hydroxyl value are lowered, whereby a fatty acid having a high polycondensation degree is obtained.

In addition, the dehydration-condensed fatty acid between a ricinoleic acid dehydration-condensed fatty acid and a carboxylic acid is obtained by further adding a monovalent carboxylic acid to a dehydration condensation product of ricinoleic acid to undergo dehydration polycondensation. Progress of the reaction is confirmed by a lowering of the hydroxyl value.

The monovalent carboxylic acid which is used in the reaction may be a saturated carboxylic acid or an unsaturated carboxylic acid. However, in the case where a carboxylic acid having a smaller carbon number remains as an unreacted material, there is a concern that an unpleasant smell or metal corrosion is caused. Thus, the monovalent carboxylic acid is preferably a carboxylic acid having 4 or more carbon atoms. Examples of a saturated carboxylic acid include caproic acid, enanthic acid, caprylic acid, 2-ethylhexanoic acid, pelargonic acid, isononanoic acid, capric acid, neodecanoic acid, lauric acid, myristic acid, palmitic acid, stearic acid, arachidic acid, behenic acid, lignoceric acid, and the like. Examples of an unsaturated carboxylic acid include undecylenic acid, oleic acid, elaidic acid, erucic acid, nervonic acid, linoleic acid, γ-linolenic acid, arachidonic acid, α-linolenic acid, stearidonic acid, eicosapentaenoic acid, docosahexanenoic acid, and the like.

<(C) Monocarboxylic Acid and Dicarboxylic Acid, Each not Containing the Component (B)>

The monocarboxylic acid and the dicarboxylic acid, each of which is used as the component (C) in the present invention, may be an unsaturated carboxylic or a saturated carboxylic acid, and may have a linear structure or a cyclic structure. A monocarboxylic acid and a dicarboxylic acid, each having 4 to 30 carbon atoms in total, are preferred.

As the monocarboxylic acid which can be used as the component (C), in addition to the monovalent carboxylic acid which is used during producing the component (B), a tall oil fatty acid and the like may be applied.

In addition, examples of the dicarboxylic acid include adipic acid, suberic acid, sebacic acid, azelaic acid, dodecane diacid, and the like.

<(D) Alkylamine (D1) and Alkanolamine (D2), Each not Containing Hydroxyl Group>

The component (D) in the present invention is an alkylamine (D1) and an alkanolamine (D2), each meeting the following (1) to (3) and not containing a hydroxyl group.

(1) The component (D1) is contained in an amount of 2 mass % or more and 30 mass % or less in the undiluted liquid composition before being diluted with water. When the content of the component (D1) is 2 mass % or more and 30 mass % or less, not only the rotting resistance is satisfactory, but also sufficient machining performance is exhibited. This content is preferably 3 mass % or more and 20 mass or less, and more preferably 4 mass % or more and 15 mass % or less.

(2) A total amount of the component (D) is a neutralization equivalent or more of the components (B) and (C). When the total amount of the component (D) is this neutralization equivalent or more, not only the emulsion dispersion stability is satisfactory, but also sufficient machining performance is exhibited.

(3) A ratio of the component (D1) in the component (D) [(D1)/(D1+D2)] is 15 mol % or more and 60 mol % or less. When this ratio is less than 15 mol %, sufficient machining performance is not obtained, whereas when the ratio is more than 60 mol %, the emulsion dispersion stability is lowered. This ratio is preferably 20 mol % or more and 55 mol % or less, and more preferably 25 mol % or more and 50 mol % or less.

Examples of the alkylamine (D1) which does not contain a hydroxyl group include linear, cyclic, or branched, saturated or unsaturated hydrocarbon group-containing alkylamines having 6 to 30 carbon atoms. In addition, examples of the hydrocarbon group may include alkyl groups such as a methyl group, an ethyl group, a propyl group, a butyl group, a hexyl group, a cyclohexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosyl group, a pentaeicosyl group, a docosyl group, a tricosyl group, a tetracosyl group, a pentacosyl group, a hexacosyl group, a hetacosyl group, an octacosyl group, a nonacosyl group, and a triacontyl group; alkenyl groups such as a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, an eicosenyl group, a heneicosenyl group, a docosenyl group, a tricosenyl group, a tetracosenyl group, a pentacosenyl group, a hexacosenyl group, a heptacosenyl group, an octacosenyl group, a nonacosenyl group, and a triacontenyl group; hydrocarbon groups having two or more double bonds; and the like.

Incidentally, in the present invention, it is preferred that the component (D1) contains at least either dicyclohexylamine or N-methyldicyclohexylamine.

In addition, examples of the alkanolamine (D2) include monoethanolamine, diethanolamine, triethanolamine, N-methylethanolamine, N,N-dimethylethanolamine, N-ethylethanolamine, N,N-diethylethanolamine, N-propylethanolamine, N,N-dipropylethanolamine, N-cyclohexyldiethanolamine, N-methyldiethanolamine, monopropanolamine, dipropanolamine, tripropanolamine, N-methylpropanolamine, N,N-dimethylpropanolamine, N-ethylpropanolamine, N,N-diethylpropanolamine, N-propylpropanolamine, N,N-dipropylpropanolamine, 2-amino-2-methylpropanol, monobutanolamine, dibutanolamine, tributanolamine, N-methylbutanolamine, N,N-dimethylbutanolamine, N-ethylbutanolamine, N,N-diethylbutanolamine, N-propylbutanolamine, N,N-dipropylbutanolamine, and the like.

Incidentally, in the above, each alkanol group may be linear, cyclic, or branched, and may have a double bond. In addition, each hydrocarbon group to be bonded to the amino group may be linear, cyclic, or branched, and may have a double bond.

<(E) Nonionic Surfactant>

The component (E) in the present invention is at least one selected from a monohydric alcohol, a polyhydric alcohol, and derivatives thereof.

Examples of the monohydric alcohol include aliphatic monohydric alcohols such as methyl alcohol, ethyl alcohol, propyl alcohol, butyl alcohol, pentyl alcohol, octanol, decanol, dodecanol, tridecanol, tetradecanol, pentadecanol, hexadecanol, heptadecanol, octadecanol (inclusive of stearyl alcohol), nonadecanol, eicosanol, heneicosanol, tricosanol, tetracosanol, hexacosanol, octacosanol, octenol, decenol, dodecenol, tridecenol, tetradecenol, pentadecenol, hexadecenol, heptadecenol, octadecenol (inclusive of oleyl alcohol), nonadecenol, eicosenol, heneicosenol, tricosenol, tetracosenol, hexacosenol, and octacosenol; alicyclic monohydric alcohols such as cyclopentyl alcohol and cyclohexyl alcohol; aromatic alcohols such as phenol, cresol, xylenol, butylphenol, and naphthol; aromatic aliphatic alcohols such as benzyl alcohol, phenethyl alcohol, and cinnamyl alcohol; and the like.

Examples of the polyhydric alcohol may include ethylene glycol, propylene glycol, butanediol, glycerin, neopentylene glycol, trimethylolpropane, pentaerythritol, hexanetriol, ditrimethylolpropane, dipentaerythritol, trihydroxystearyl alcohol, sorbitol, polyethylene glycol, polypropylene glycol, polyethylene-polypropylene glycol, and the like.

Incidentally, in the above, each hydrocarbon group to be bonded to the alcohol group may be linear, cyclic, or branched, and may have a double bond.

Furthermore, examples of the derivative of monohydric alcohol include adducts of ethylene oxide, propylene oxide, etc. to the above-described monohydric alcohol, and the like; and examples of the derivative of polyhydric alcohol include adducts of ethylene oxide, propylene oxide, etc. to the above-described polyhydric alcohol, and the like. In addition, examples further include ester compounds of the above-described alcohol and the above-described carboxylic acid, such as a sorbitan fatty acid ester, a polyoxyethylene sorbitan fatty acid ester, and a polyoxyethylene fatty acid ester; amide compounds such as a fatty acid alkanol amide; and the like.

A compounding amount of the component (E) in the oil agent is preferably 1 mass % or more and 20 mass % or less.

<(F) Water>

In the water-soluble metalworking oil agent (undiluted liquid composition) of the present invention, a prescribed amount of water may be contained, as needed. From the viewpoint of imparting water solubility, an amount of water is preferably 3 mass % or more and 50 mass % or less, more preferably 4 mass % or more and 45 mass % or less, and still more preferably 6 mass % or more and 40 mass % or less relative to a total amount of the water-soluble metalworking oil agent.

<Other Compounding Agents>

In the water-soluble metalworking oil agent of the present invention, other components may be further compounded within a range where the object of the present invention is not impaired. For example, a surfactant, a lubricity improver, a metal deactivator, a defoaming agent, an antiseptic, an antioxidant, and the like may be compounded.

(Surfactant)

Examples of the surfactant include anionic surfactants, cationic surfactants, amphoteric surfactants, and the like. Examples of the anionic surfactant include an alkylbenzenesulfonate, an α-olefin sulfonate, and the like. Examples of the cationic surfactant include quaternary ammonium salts such as an alkyltrimethylammonium salt, a dialkyldimethylammonium salt, and an alkyldimethylbenzylammonium salt, and the like. Examples of the amphoteric surfactant include alkylbetaines as a betaine-based surfactant, and the like.

(Lubricity Improver)

Examples of the lubricity improver include mineral oils such as paraffin-based or naphthene-based mineral oils; synthetic oils such as poly-α-olefins, alkylbenzenes, and esters; vegetable oils such as castor oil and rapeseed oil; fats and oils such as lanolin; purified products thereof; and the like.

(Metal Deactivator and Antioxidant)

Examples of the metal deactivator include benzotriazole, imidazoline, pyrimidine derivatives, thiadiazole, sodium phosphate, phosphate derivatives, and the like.

Examples of the antioxidant include amine-based antioxidants such as an alkylated diphenylamine, phenyl-α-naphthylamine, and an alkylated phenyl-α-naphthylamine; phenol-based antioxidants such as 2,6-di-t-butylphenol, 4,4'-methylenebis(2,6-di-t-butylphenol), isooctyl-3-(3,5-di-t-butyl-4-hydroxyphenyl)propionate, and n-octadecyl-3-(3,5-di-t-butyl-4-hydroxyphenyl)propionate; sulfur-based antioxidants such as dilauryl-3,3'-thiodipropionate; phosphorus-based antioxidants such as a phosphite; molybdenum-based antioxidants; and the like.

(Antiseptic and Defoaming Agent)

Examples of the antiseptic include a triazine-based antiseptic, an alkylbenzimidazole-based antiseptic, an isothiazoline-based antiseptic, a pyridine-based antiseptic, a phenol-based antiseptic, a pyrithione-based antiseptic, and the like.

Examples of the defoaming agent include a silicone-based compound, a polyether-based compound, and the like.

[Metalworking Liquid]

The metalworking liquid of the present invention is produced by diluting the water-soluble metalworking oil agent (undiluted liquid composition) of the present invention with water. Here, the water may be any of water for industrial use, tap water, well water, ion-exchanged water, distilled water, or the like, and it is not particularly limited. A concentration at which the water-soluble metalworking oil agent of the present invention is diluted is preferably 3 volume or more and 20 volume % or less, more preferably 5 volume % or more, and still more preferably 10 volume % or more. When the dilution concentration is less than 3 volume %, there is a concern that sufficient machining performance may not be obtained. On the other hand, when it is more than 20 volume %, there is a possibility that stability of the diluted liquid may be impaired.

Next, the metalworking method of the present invention is described.

[Metalworking Method]

The metalworking method of the present invention comprises machining a workpiece made of aluminum or an aluminum alloy, with the above-described water-soluble metalworking oil agent (undiluted liquid composition) or the metalworking liquid obtained by diluting the water-soluble metalworking oil agent with water.

Examples of the kind of the metalworking which may be suitably utilized include various metal machining processes such as cutting, grinding, punching, polishing, deep drawing, drawing, and rolling. As for the water-soluble metalworking oil agent or the metalworking liquid of the present invention, particularly preferred machining performance may be obtained in the case when it is used for cutting or grinding of a workpiece made of aluminum or an aluminum alloy.

According to the present invention, more efficient machining of aluminum or an aluminum alloy may be realized; in the view of the fact that rotting deterioration is hardly caused, the working environment may be kept well; and because of excellent emulsion dispersion stability, it is possible to reduce the use amount of the oil agent. Furthermore, because of excellent stability of undiluted liquid, the workability is not impaired in the environments of various production sites.

EXAMPLES

The present invention is hereunder described in more detail by reference to Examples, but it should not be construed that the present invention is limited to the following Examples. Characteristics of the water-soluble metalworking oil agents and the metalworking liquids according to the Examples and Comparative Examples were evaluated by the following evaluation methods.

<Respective Evaluation Methods>

(1) Evaluation of Stability of Undiluted Liquid 80 ml of each of the undiluted liquids of water-soluble metalworking oil agent (cutting or grinding oil agent) was charged in a 100-mL transparent glass bottle and allowed to stand in a thermostat at 0° C., 25° C., and 50° C., respectively for 24 hours, followed by observing its appearance. Then, the stability of undiluted liquid was evaluated according to the following evaluation criteria.

(Evaluation Criteria of Stability of Undiluted Liquid)

Accepted: Free from separation, sedimentation/precipitation, and solidification

Rejected: Found for separation, sedimentation/precipitation, or solidification (2) Evaluation of Dispersion Stability (Stability of Undiluted Liquid)

Each of the undiluted liquids of water-soluble metalworking oil agent (cutting or grinding oil agent) was diluted with a magnesium-adjusted water (Mg-adjusted water), which was obtained by adjusting with water and magnesium chloride so as to contain 200 ppm of a magnesium ion, to a concentration of 5 volume %, and after 24 hours, its appearance was observed. Then, the dispersion stability was evaluated according to the following evaluation criteria.

Accepted: Free from separation and heterogeneity

Rejected: Found for separation or heterogeneity (3) Evaluation of Machining Performance Each of the undiluted liquids of water-soluble metalworking oil agent (cutting or grinding oil agent) was diluted with water to a concentration of 5 volume %, and drilling for prepared holes was performed under the following conditions, followed by performing form roll tapping. Then, a maximum tap torque during the form roll tapping was measured. An average value of the results was evaluated according to the criteria shown in Table 1.

(Machining Conditions of Drilling for Prepared Holes and Form Roll Tapping)

Machine Used

Tapping center MTV-T350, manufactured by Mectron Inc.

Workpiece

A6061 (JIS standards) and A390 (AA Standards)

Machining for Prepared Holes

Tool used: Igetalloy Supermulti Drill MDS093MG T4120, manufactured by Sumitomo Electric Hardmetal Corporation, drill diameter: 9.3 mm Speed: 80 m/min Feed: 0.15 mm/rev Depth: 30 mm (blind hole)

Tapping

Tool used: New Roll Tap, B-NRT, M10×P1.5, manufactured by OSG Corporation

Speed: 20 m/min

Depth: 25 mm

No. of Workpiece (n): 9

The evaluation criteria of machining performance are shown in Table 1.

TABLE 1

| | Workpiece | |
|---|---|---|
| Decision | A6061 | A390 |
| Excellent | Less than 8.0 N · m | Less than 10.0 N · m |
| Inferior | 8.0 N · m or more | 10.0 N · m or more |

(4) Rotting Resistance

To 100 mL of a sample prepared by diluting each of the undiluted liquids of water-soluble metalworking oil agent (cutting or grinding oil agent) with water to a concentration of 3 volume %, 5 mL of a rotted liquid A and 0.5 mL of a rotted liquid B, each shown below, were added, and the mixture was subjected to shake culturing at 30° C. and 150 rpm for 7 days. On the 7 day, 2.5 mL of the rotted liquid A and 0.25 mL of the rotted liquid B were added, and the resultant was further subjected to shake culturing for 7 days. Then, the number of viable cells was counted. Incidentally, the totting test conditions and the counting method of the number of viable cells are as follows.

(Rotting Test Conditions)

Culturing Conditions:

3 g of FC200 dry shavings was added, and the mixture was shaken at 30° C. and 150 rpm.

Rotted Liquid A:

To an emulsion-type cutting liquid which had been rotted and deteriorated, an SCD medium "Daigo", manufactured by Nihon Pharmaceutical Co., Ltd. was added, and the mixture was activated by means of aeration for 72 hours.

Rotted Liquid B:

To an emulsion-type cutting liquid which had been rotted and deteriorated, a potato dextrose agar medium "Daigo", manufactured by Nihon Pharmaceutical Co., Ltd. was added, and the mixture was activated by means of aeration for 72 hours.

(Counting Method of the Number of Viable Cells)

The number of bacterial cells in a sample (1 mL) was counted by a "San-Ai Bio-checker TTC", manufactured by San-Ai Oil Co. Ltd. at 6 levels of less than $10^3$ cells/mL, $10^3$ cells/mL, $10^4$ cells/mL, $10^5$ cells/mL, $10^6$ cells/mL, and $10^7$ cells/mL, and the rotting resistance was evaluated according to the following evaluation criteria.

(Evaluation Criteria of Rotting Resistance)

Extremely excellent: $10^3$ cells/mL or less

Excellent: $10^4$ cells/mL or more and $10^5$ cells/mL or less

Inferior: $10^6$ cells/mL or more

Examples 1 to 7

(Preparation of Water-Soluble Metalworking Oil Agent>

The undiluted liquid of a water-soluble metalworking oil agent (cutting or grinding oil agent) used in each of the Examples was prepared by compounding the base materials in a compounding proportion as shown in Table 2.

TABLE 2

| Formulation (mass %) | Example 1 | Example 2 | Example 3 | Example 4 | Example 5 | Example 6 | Example 7 |
|---|---|---|---|---|---|---|---|
| 1-Tetradecene | 10 | 21 | 28 | 10 | 15 | 15 | 20 |
| 1-Hexadecene | 15 | 21 | 28 | 15 | 15 | 15 | 28 |
| 1-Octadecene | — | — | — | — | — | — | — |
| Mineral oil | — | — | — | — | — | — | — |
| Polycondensed fatty acid 1 | 18 | — | — | 18 | — | — | — |
| Polycondensed fatty acid 2 | — | 10 | 8 | — | — | — | — |
| Polycondensed fatty acid 3 | — | — | — | — | 14 | 14 | 12 |
| Tall oil fatty acid | 5 | 10 | 8 | 5 | 5 | 5 | 5 |
| Neodecanoic acid | 3 | 7 | 5 | 3 | 3 | 3 | 3 |
| Pelargonic acid | 3 | — | — | 3 | 2 | 2 | — |
| Dodecane diacid | 1 | 1 | 0.5 | 1 | 1 | 1 | 1 |
| Sebacic acid | 2 | 1 | 0.5 | 2 | 1 | 1 | 1 |
| Dicyclohexylamine | 10 | 10 | 5 | — | — | — | — |
| N-Methyldicyclohexylamine | — | — | — | 10 | 12 | 12 | 10 |
| Monoisopropanolamine | 5 | 6 | 5 | 5 | — | 4 | 5 |
| 2-Amino-2-methylpropanol | — | — | — | — | 4 | — | — |
| N-Cyclohexyldiethanolamine | — | — | — | — | 6 | 6 | — |
| N-Methyldiethanolamine | 5 | — | — | 5 | — | — | — |
| Nonionic surfactant 1 | 3 | 4 | 2 | 3 | 6 | 6 | 4 |

TABLE 2-continued

| Formulation (mass %) | Example 1 | Example 2 | Example 3 | Example 4 | Example 5 | Example 6 | Example 7 |
|---|---|---|---|---|---|---|---|
| Nonionic surfactant 2 | 1 | — | — | 1 | — | — | 2 |
| Nonionic surfactant 3 | — | — | 1 | — | — | — | — |
| Water | 18 | 8 | 8 | 18 | 15 | 15 | 8 |
| Benzotriazole | 1 | 1 | 1 | 1 | 1 | 1 | 1 |
| Compounding ratio of α-olefin (mass %) | 25 | 42 | 56 | 25 | 30 | 30 | 48 |
| Compounding ratio of polycondensate (mass %) | 18 | 10 | 8 | 18 | 14 | 14 | 12 |
| Compounding ratio of D1 (mass %) | 10 | 10 | 5 | 10 | 12 | 12 | 10 |
| D1/(D1 + D2) (mol %) | 34 | 41 | 29 | 32 | 46 | 42 | 43 |

Details of the compounding base materials shown in the foregoing Table 2 are as follows.

Mineral oil (kinetic viscosity at 40° C.: 9.5 $mm^2/s$, kinetic viscosity at 100° C.: 2.3 $mm^2/s$)

Polycondensed fatty acid 1 (condensate obtained by subjecting ricinolic acid to thermal dehydration condensation at 200° C. under a nitrogen gas stream, acid value: 34 mgKOH/g, hydroxyl value: 28 mgKOH/g, saponification value: 198 mgKOH/g)

Polycondensed fatty acid 2 (condensate obtained by subjecting ricinolic acid to thermal dehydration condensation at 200° C. under a nitrogen gas stream, acid value: 53 mgKOH/g, hydroxyl value: 42 mgKOH/g, saponification value: 196 mgKOH/g)

Polycondensed fatty acid 3 (condensate obtained by subjecting ricinolic acid to thermal dehydration condensation at 200° C. under a nitrogen gas stream, further adding oleic acid, and subjecting the mixture to thermal dehydration condensation, acid value: 85 mgKOH/g, hydroxyl value: 15 mgKOH/g, saponification value: 195 mgKOH/g)

Nonionic surfactant 1 (polyoxyethylene propylene monoalkylene ether, HLB: 13)

Nonionic surfactant 2 (diethylene glycol monobutyl ether)

Nonionic surfactant 3 (oleyl alcohol)

(Performance Evaluation)

By using each of the above-prepared water-soluble metalworking oil agents and the like, each of the above-described evaluations was performed. The evaluation results are summarizingly shown in Table 3.

TABLE 3

| | | Example 1 | Example 2 | Example 3 | Example 4 | Example 5 | Example 6 | Example 7 |
|---|---|---|---|---|---|---|---|---|
| Stability of undiluted liquid | 0° C. | Accepted | Accepted | Accepted | Accepted | Accepted | Accepted | Accepted |
| | 25° C. | Accepted | Accepted | Accepted | Accepted | Accepted | Accepted | Accepted |
| | 50° C. | Accepted | Accepted | Accepted | Accepted | Accepted | Accepted | Accepted |
| Dispersion stability | Tap water | Accepted | Accepted | Accepted | Accepted | Accepted | Accepted | Accepted |
| | Magnesium-adjusted water | Accepted | Accepted | Accepted | Accepted | Accepted | Accepted | Accepted |
| Machining performance | Machining torque of A6061 (N · m) | 7.7 | 7.4 | 7.5 | 7.6 | 7.6 | 7.5 | 7.4 |
| | Decision of A6061 | Excellent | Excellent | Excellent | Excellent | Excellent | Excellent | Excellent |
| | Machining torque of A390 (N · m) | 9.5 | 9.4 | 9.5 | 9.5 | 9.5 | 9.5 | 9.4 |
| | Decision of A390 | Excellent | Excellent | Excellent | Excellent | Excellent | Excellent | Excellent |
| Rotting resistance | Number of viable cells (cells/mL) | $10^3$ or less | $10^3$ or less | $10^4$ | $10^3$ or less | $10^3$ or less | $10^3$ or less | $10^3$ or less |
| | Decision | Extremely excellent | Extremely excellent | Excellent | Extremely excellent | Extremely excellent | Extremely excellent | Extremely excellent |

Comparative Examples 1 to 10

Each of undiluted liquids of water-soluble metalworking oil agent (cutting or grinding oil agent) was prepared by compounding the base materials in a compounding proportion as shown in the following Table 4 similarly to the foregoing Examples 1 to 7, and then similarly subjected to various performance evaluations. The results obtained are shown in Table 5.

TABLE 4

| Formulation (mass %) | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 |
|---|---|---|---|---|---|---|---|---|---|---|
| 1-Tetradecene | 8 | — | — | — | — | 30 | 23 | 10 | 28 | 25 |
| 1-Hexadecene | 8 | — | — | — | — | 30 | 23 | 15 | 28 | 26 |
| 1-Octadecene | — | 43 | 56 | — | — | — | — | — | — | — |
| Mineral oil | — | — | — | 42 | 48 | — | — | — | — | — |
| Polycondensed fatty acid 1 | 18 | — | — | — | — | — | — | — | — | — |
| Polycondensed fatty acid 2 | — | 10 | 8 | 10 | — | 4 | — | — | 8 | 8 |
| Polycondensed fatty acid 3 | — | — | — | — | 12 | — | 16 | 18 | — | — |
| Tall oil fatty acid | 5 | 10 | 8 | 10 | 5 | 8 | 4 | 4 | 8 | 8 |
| Neodecanoic acid | 3 | 7 | 5 | 7 | 3 | 5 | 4 | 3 | 5 | 5 |

TABLE 4-continued

| Formulation (mass %) | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 |
|---|---|---|---|---|---|---|---|---|---|---|
| Pelargonic acid | 3 | — | — | — | — | — | 1 | 1.5 | — | — |
| Dodecane diacid | 1 | 1 | 0.5 | 1 | 1 | 0.5 | 1 | 1.5 | 0.5 | 0.5 |
| Sebacic acid | 2 | 1 | 0.5 | 1 | 1 | 0.5 | — | — | 0.5 | 0.5 |
| Dicyclohexylamine | 10 | 10 | 5 | 10 | — | 5 | — | 4 | 8 | 15 |
| N-Methyldicyclohexylamine | — | — | — | — | 10 | — | — | — | — | — |
| Monoisopropanolamine | 5 | 6 | 5 | 6 | 5 | 5 | 2 | 4 | 2 | — |
| 2-Amino-2-methylpropanol | — | — | — | — | — | — | — | — | — | — |
| N-Cyclohexyldiethanolamine | — | — | — | — | — | — | 15 | 8 | — | — |
| N-Methyldiethanolamine | 5 | — | — | — | — | — | — | 5 | — | — |
| Nonionic surfactant 1 | 3 | 3 | 2 | 4 | 4 | 2 | 2 | 3 | 2 | 2 |
| Nonionic surfactant 2 | 1 | — | — | — | 2 | — | — | 1 | — | — |
| Nonionic surfactant 3 | — | — | 1 | — | — | 1 | — | — | 1 | 1 |
| Water | 27 | 8 | 8 | 8 | 8 | 8 | 8 | 21 | 8 | 8 |
| Benzotriazole | 1 | 1 | 1 | 1 | 1 | 1 | 1 | 1 | 1 | 1 |
| Compounding ratio of α-olefin (mass %) | 16 | 43 | 56 | 0 | 0 | 60 | 46 | 25 | 56 | 51 |
| Compounding ratio of polycondensate (mass %) | 18 | 10 | 8 | 10 | 12 | 4 | 16 | 18 | 8 | 8 |
| Compounding ratio of D1 (mass %) | 10 | 10 | 5 | 10 | 10 | 5 | 0 | 4 | 8 | 15 |
| D1/(D1 + D2) (mol %) | 34 | 41 | 29 | 41 | 43 | 29 | 0 | 14 | 62 | 100 |

TABLE 5

| | | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 |
|---|---|---|---|---|---|---|---|---|---|---|---|
| Stability of undiluted liquid | 0° C. | Accepted | Rejected (solidified) | Rejected | Accepted | Accepted | Rejected | Accepted | Accepted | Accepted | Rejected |
| | 25° C. | Accepted | Accepted | Rejected | Accepted | Accepted | Rejected | Accepted | Accepted | Accepted | Rejected |
| | 50° C. | Accepted | Accepted | Rejected | Accepted | Accepted | Rejected | Accepted | Accepted | Accepted | Rejected |
| Dispersion stability | Tap water | Accepted | Accepted | — | Accepted | Accepted | — | Accepted | Accepted | Rejected | — |
| | Magnesium-adjusted water | Accepted | Rejected | — | Accepted | Accepted | — | Accepted | Accepted | Rejected | — |
| Machining performance | Machining torque of A6061 (N ·m) | 9.1 | 7.4 | — | 8.6 | 8.5 | — | 8.3 | 8.9 | — | — |
| | Decision of A6061 | Inferior | Excellent | — | Inferior | Inferior | — | Inferior | Inferior | — | — |
| | Machining torque of A390 (N ·m) | 11.2 | 9.4 | — | 10.6 | 10.6 | — | 10.2 | 10.8 | — | — |
| | Decision of A390 | Inferior | Excellent | — | Inferior | Inferior | — | Inferior | Inferior | — | — |
| Rotting resistance | Number of viable cells (cells/mL) | $10^3$ or less | $10^3$ or less | — | $10^3$ or less | $10^3$ or less | — | $10^6$ | $10^4$ | — | — |
| | Decision | Extremely excellent | Extremely excellent | — | Extremely excellent | Extremely excellent | — | Inferior | Excellent | — | — |

INDUSTRIAL APPLICABILITY

According to the water-soluble metalworking oil agent, the metalworking liquid, and the metalworking method using the same of the present invention, more efficient machining of aluminum or an aluminum alloy may be realized; in the view of the fact that rotting deterioration is hardly caused, the working environment may be kept well; and because of excellent emulsion dispersion stability, it is possible to reduce the use amount of the oil agent. Furthermore, because of excellent stability of undiluted liquid, the workability is not impaired in the environments of various production sites.

The invention claimed is:

1. A water-soluble metalworking oil agent comprising, the following (A) to (E):

(A) an α-olefin component consisting of one or more C14 to C16 α-olefins, in a content of 20 mass % or more and 65 mass % or less, wherein at least 40 mass % of the α-olefin component is a C14 α-olefin;

(B) at least one selected from the group consisting of a dehydration-condensed fatty acid of ricinoleic acid and a dehydration-condensed fatty acid between a ricinoleic acid dehydration-condensed fatty acid and a carboxylic acid, in a content of 5 mass % or more and 30 mass % or less;

(C) at least one tall oil fatty acid and at least one C9 to C12 monocarboxylic acid and a dicarboxylic acid, each not containing the component (B), wherein the total amount of (C) is from 10 to 19 mass %;

(D) an alkylamine (D1) not containing a hydroxyl group and an alkanolamine (D2), each meeting the following (1) to (3), (1) a content of the component (D1) is 2 mass % or more and 30 mass % or less, (2) a total amount of the component (D) is a neutralization equivalent or more of the components (B) and (C), and (3) a ratio of the component (D1) in the component (D) [(D1)/(D1+D2)] is 15 mol% or more and 60 mol% or less; and (E) at least one nonionic surfactant selected from the group consisting of a monohydric alcohol, a polyhydric alcohol, and derivatives thereof, wherein mass % is based on the total mass of the water-soluble metalworking oil agent.

2. The water-soluble metalworking oil agent according to claim 1, wherein the component (D1) contains at least either dicyclohexylamine or N-methyldicyclohexylamine.

3. The water-soluble metalworking oil agent according to claim 1, further comprising (F) water.

4. A metalworking method comprising:

machining a workpiece made of aluminum or an aluminum alloy, with the water-soluble metalworking oil agent according to claim 1.

5. A metalworking method comprising:

machining a workpiece made of aluminum or an aluminum alloy, with the metalworking liquid according to claim 2.

6. The metalworking method according to claim 4, wherein the metalworking method is cutting or grinding.

7. The water-soluble metalworking oil agent according to claim 1, wherein the α-olefin is present in a total amount of from 25 to 61 mass %.

8. The water-soluble metalworking oil agent according to claim 7, wherein component (B) is present in a total amount of from 9 to 22 mass %.

9. The water-soluble metalworking oil agent according to claim 8, wherein component (C) is present in an amount of from 14 to 21 mass %.

10. The water-soluble metalworking oil agent according to claim 9, wherein total amount of components (D1) and (D2) is from 10 to 20 mass %.

11. The water-soluble metalworking oil agent according to claim 10, wherein total amount of component (D1) is from 5 to 12 mass %.

12. The water-soluble metalworking oil agent according to claim 11, wherein total amount of component (D2) is from 5 to 10 mass %.

13. The water-soluble metalworking oil agent according to claim 1, wherein total amount of component (E) is from 3 to 7 mass %.

14. The water-soluble metalworking oil agent according to claim 1, wherein the compounding ratio [(D1)/(D1+D2)] is from 32 to 46 mol %.

15. The water-soluble metalworking oil agent according to claim 1, wherein the (D) is present in a total amount of from 11 to 26 mass %.

16. A water-soluble metalworking oil agent comprising, the following (A) to (E):

(A) an α-olefin component consisting of one or more C14 to C16 α-olefins, in a content of 20 mass % or more and 65 mass % or less, wherein at least 40 mass % of the α-olefin composition is a C14 α-olefin;

(B) at least one selected from the group consisting of a dehydration-condensed fatty acid of ricinoleic acid and a dehydration-condensed fatty acid between a ricinoleic acid dehydration-condensed fatty acid and a carboxylic acid, in a content of 5 mass % or more and 30 mass % or less;

(C) two or more C9 to C12 compounds selected from the group consisting of a monocarboxylic acid and a dicarboxylic acid, each not containing the component (B), wherein the total amount of (C) is from 10 to 19 mass %;

(D) an alkylamine (D1) not containing a hydroxyl group and an alkanolamine (D2), each meeting the following (1) to (3), (1) a content of the component (D1) is 2 mass % or more and 30 mass % or less, (2) a total amount of the component (D) is a neutralization equivalent or more of the components (B) and (C), and (3) a ratio of the component (D1) in the component (D) [(D1)/(D1+D2)] is 15 mol % or more and 60 mol % or less; and (E) at least one nonionic surfactant selected from the group consisting of a monohydric alcohol, a polyhydric alcohol, and derivatives thereof, wherein mass % is based on the total mass of the water-soluble metalworking oil agent.

17. The water-soluble metalworking oil agent according to claim 16, wherein the component (C) contains at least one monocarboxylic acid and at least one dicarboxylic acid.

18. A metalworking liquid comprising from 3 to 20 volume % of the water-soluble metalworking oil agent according to claim 1 in water.

19. A metalworking liquid comprising from 3 to 20 volume % of the water-soluble metalworking oil agent according to claim 16 in water.

* * * * *